US005509809A

United States Patent [19]

Clay

[11] Patent Number: 5,509,809

[45] Date of Patent: Apr. 23, 1996

[54] LEAD ARM WRIST POSITION TRAINING DEVICE

[76] Inventor: Haile S. Clay, P.O. Box 326, LaHonda, Calif. 94020

[21] Appl. No.: 326,067

[22] Filed: Oct. 19, 1994

Related U.S. Application Data

[63] Continuation of Ser. No. 136,538, Oct. 14, 1993, abandoned.

[51] Int. Cl.[6] ..... A63B 69/36

[52] U.S. Cl. ..... 473/202; 473/212; 473/213;

[58] Field of Search ..... 273/266, 29 A, 273/35 R, 183.1, 187.2, 187.5, 188 R, 188 R, 189 R, 190 A, 62, 213; 434/252

[56] References Cited

U.S. PATENT DOCUMENTS

| | | | |
|---|---|---|---|
| 3,368,817 | 2/1968 | Duncan | 273/187.2 |
| 3,717,857 | 2/1973 | Evans | 273/187.2 X |
| 3,811,684 | 5/1974 | Tredway Sr. | 273/187.2 |
| 3,861,688 | 1/1975 | Butler | 273/187.2 |
| 4,193,065 | 3/1980 | Bittner | 273/187.2 X |
| 4,222,569 | 9/1980 | DeMascolo | 273/187.2 |
| 4,699,379 | 10/1987 | Chateau et al. | 273/187.2 X |
| 4,743,028 | 5/1988 | Harrison | 273/187.2 X |
| 5,116,057 | 5/1992 | Mangiaracina | 273/187.2 |
| 5,199,712 | 4/1993 | Hoyle, Jr. et al. | 273/187.2 |
| 5,324,038 | 6/1994 | Sasser | 273/187.2 |

*Primary Examiner*—Richard J. Apley
*Assistant Examiner*—Glenn E. Richman
*Attorney, Agent, or Firm*—Flehr Hohbach Test Albritton & Herbert

[57] ABSTRACT

The present invention is a golf training device that will help the golfer train himself to maintain the proper arm and wrist position. This invention consists of a glove which is modified by the addition of a pocket to the back of the glove. In this pocket fits an electronic attachment with a sensory mechanism. This sensing mechanism will sense arm and wrist positions and compare these positions to predetermined ones registered in the electronic circuit. If the golfer's body members repeat the predetermined positions a signal will alert the golfer that the proper position has been achieved.

11 Claims, 4 Drawing Sheets

LEAD ARM WRIST POSITION TRAINING DEVICE

This is a continuation of application Ser. No. 08/136,538, filed Oct. 14, 1993, now abandoned.

FIELD OF THE INVENTION

The present invention relates to a golf swing training aid. More specifically, this invention relates to a training aid for teaching a golfer the proper technique for executing a consistent and dependable golf swing through the use of immediate feedback.

BACKGROUND OF THE INVENTION

The positioning of the wrist on the lead, or forward, arm is an important factor in developing the ultimate golf swing. There are three keys to wrist position: non-rotation, cock and grip. The lead arm at the wrist joint must not rotate during the swing, it must remain firm and in line with the forearm. Keeping the wrist in line with the forearm keeps the club along the plane of the swing. Cocking the wrist allows the full extension of the club head, keeping the head along the arc of the golf swing. Full extension of the club head is key to maximum acceleration during the downswing. Because the basic principles of physics state that force equals mass times acceleration, it is easy to understand that maximum acceleration of the club will lead to maximum driving force/power of the swing. Finally, cocking is impossible without the proper grip. For the wrists to cock freely, the inside-hand grip must be held lightly while the lead arm hand is held firm.

Thus, golfers are constantly advised, or reminding themselves, to maintain a firm wrist, yet allowing the wrist to cock at the top of the backswing without actual rotation. Those striving for optimal performance will welcome a device which will alert them when the proper arm and wrist position has been achieved.

OBJECTIVES AND SUMMARY OF THE INVENTION

It is therefore a general objective of the present invention to provide an effective device through which the golfer can improve upon his/her current swing.

It is a further objective of the present invention to train the golfer to develop a consistent, forceful swing by properly cocking, without rotating, the arm or wrists.

It is another objective to provide the golfer with immediate feedback such that he/she can realize the optimal arm and wrist position without distraction or interference.

It is still another objective to provide a training device that will not restrict body movement in any way.

It is still another objective to provide a training device that is independent of other devices and will not interfere with such devices.

It is still another objective to provide a training device that may be universally used by all golfers.

It is still another objective to provide a device that can be used both during practice and actual play.

It is still another objective to provide a device that although designed with the sport of golf in mind is not limited to this sport.

In accordance with these and other objectives, the present invention is an improved teaching and practice device that will sense and indicate the movements of the arm and wrist joint. The present invention is a modified glove apparatus worn on the hand of the lead arm. An independent, lightweight sensing mechanism is attached to and housed by the glove apparatus in such a way that the movements of attached body members are tracked. The sensing mechanism is set to indicate when predetermined angles of attached body members are achieved. When the predetermined positions are repeated by the body movements the sensing mechanism generates a feedback signal. The generated will signal only be produced when the proper arm position is achieved, taking the golfer one step closer to the optimal swing. Thus, if the arm improperly rotates no signal will be emitted. Further, if an improper grip does not allow the wrist to cock, or the grip is proper but cocking still does not occur, again no signal will be emitted. Thus, using this invention as a type of conditioned response training device the golfer will learn over time to naturally hold the arm and wrist in their proper positions.

This device can be adjusted for varying degrees of sensitivity. Further, the invention is made of flexible material and will only alert the golfer of actual position, it will not restrict body movement in any way. This device is light weight and easily attachable to the body for maximum comfort. Ultimately, this device will allow the golfer to know when he/she has executed a swing with the correct and optimal arm and wrist position.

This invention was designed to operate independent of other attachments or devices. Further, this invention will not interfere with the use of other devices. The invention was designed to be used by all golfers, male or female, right handed or left handed. Further, because this device is an electronically modified glove, it can be used not only for practice but for regulation play as well. (No claims are made as to acceptability for tournament play). The electronic mechanism is independent of the modified glove, thus, the modified glove may be replaced when it is worn out. Finally, this invention although designed for golf is not limited to this sport as it can be used to detect body movement in any sport.

DETAILED DESCRIPTION OF THE DRAWINGS

Figure 1:
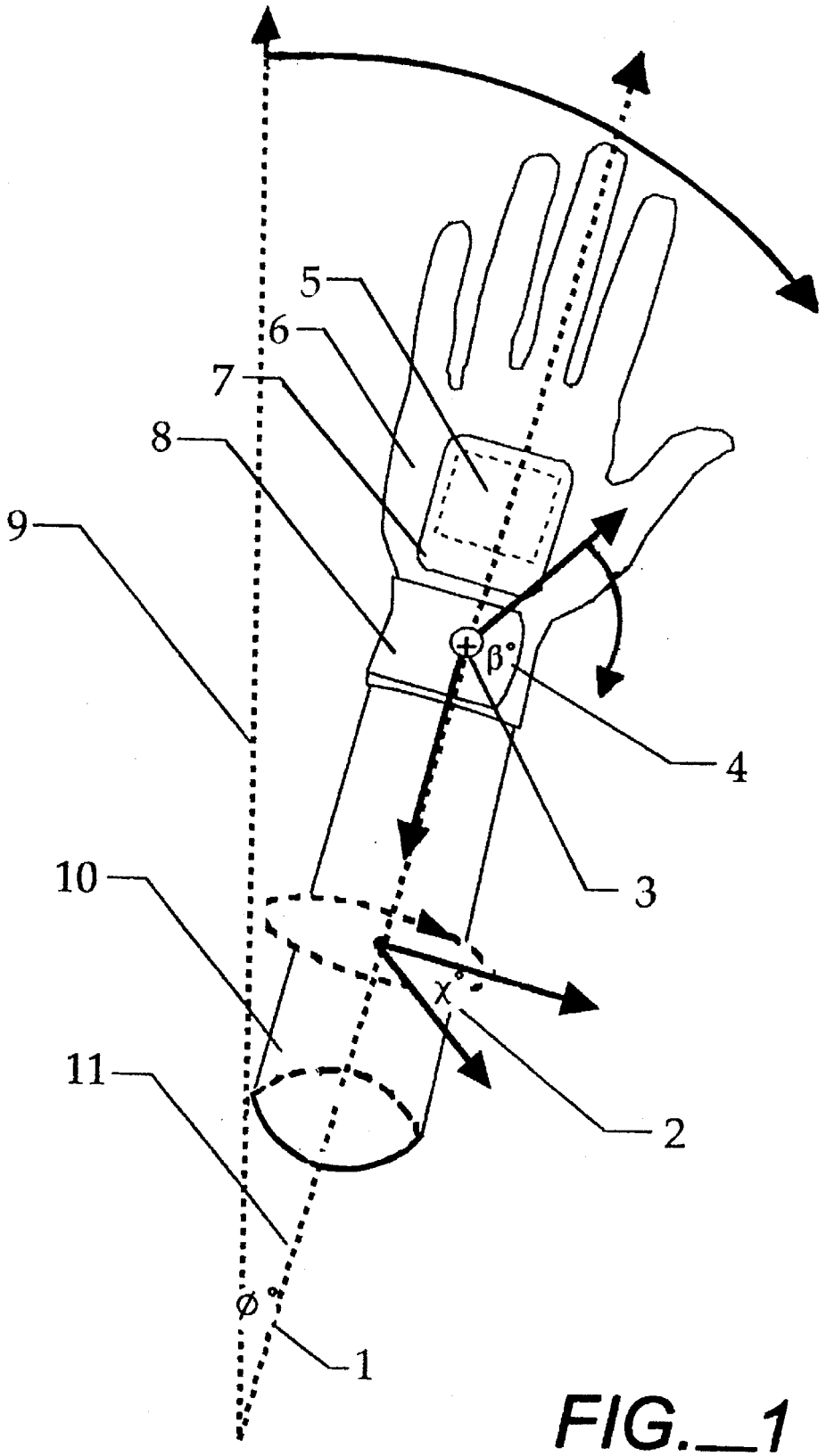
FIG. 1 shows the desired predetermined angles.

FIG. 1 shows a sensing mechanism 5 concealed within a pliable, waterproof pocket 7. Said pocket is attached to a glove 6 suitable for golfing. The glove 6 is secured to the hand by an adjustable tension strap 8. The sensing mechanism produces a positive feedback signal when three predetermined angles are simultaneously achieved. First, when the human arm 10 creates a predetermined angle 1 of $\theta$ degrees around its axis 11. Second, when the arm's angle of rotation about the axis 11 reaches a predetermined angle 2 of $\chi$ degrees in relation to the shoulder height 9. Third, when the arm angle about the wrist 3 creates of a predetermined angle 4 of β degrees.

Figure 2:
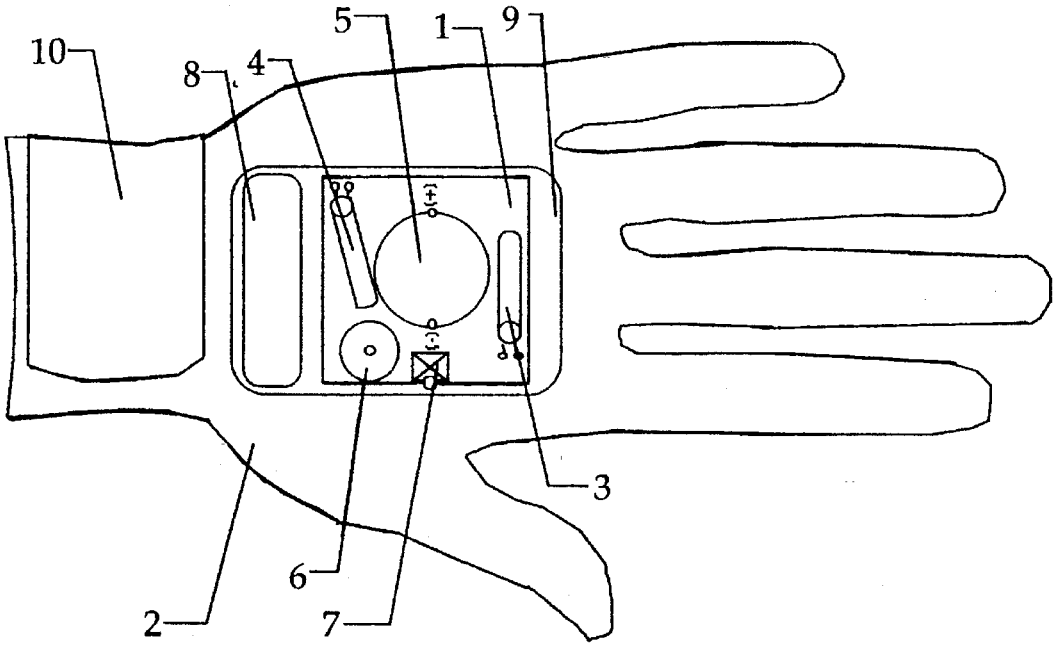
FIG. 2 shows a top view of the invention.
Figure 3A:
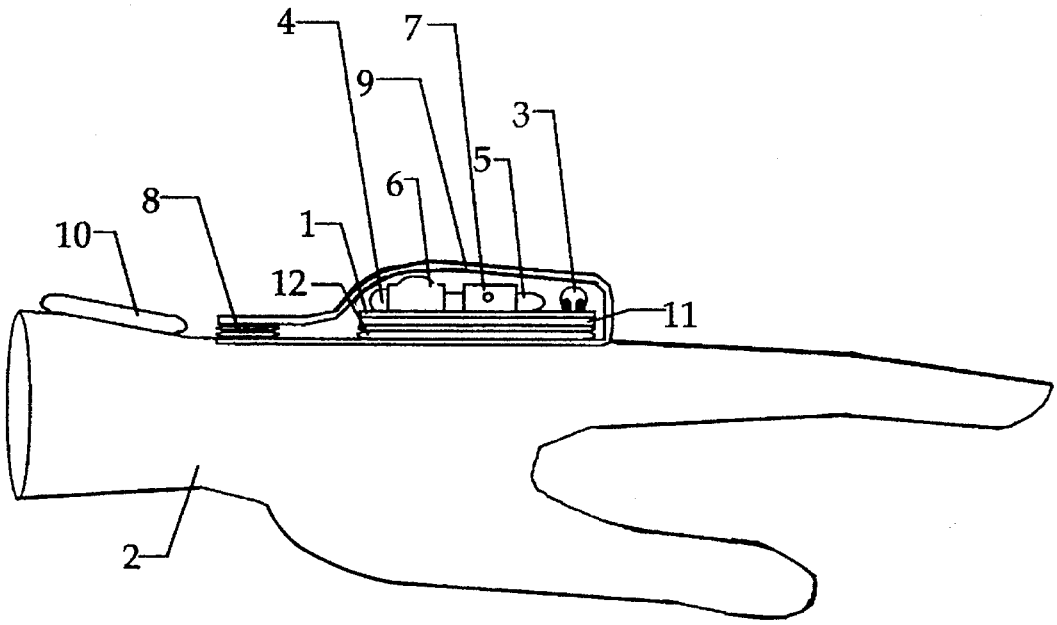
FIG. 3*a* shows a side view of the invention if a left hand glove is used.

FIGS. 2 and 3*a* show the circuitry of the sensing mechanism 1. Elevation sensitive switches 3, 4 are positioned in such a way that when all aforementioned predetermined angles are achieved the elevation sensitive switch gates are closed. When the elevation sensitive switches 3, 4 are closed they will close the electronic circuit thereby allowing a power source to stimulate the electronic transducer 6 to produce a signal. The power source generates the current that produces the signal. An on/off switch 7 controls and preserves the power source 5. The sensing mechanism 1 is secured to a support pad 11 which is attached to the glove by a fastening material 12 such as velcro. The pocket 9 and the glove 2 are both closed along the back of the hand and fastened near the wrist by a material 8 such as velcro. The glove is secured to the hand by a tension strap 10.

Figure 3B:
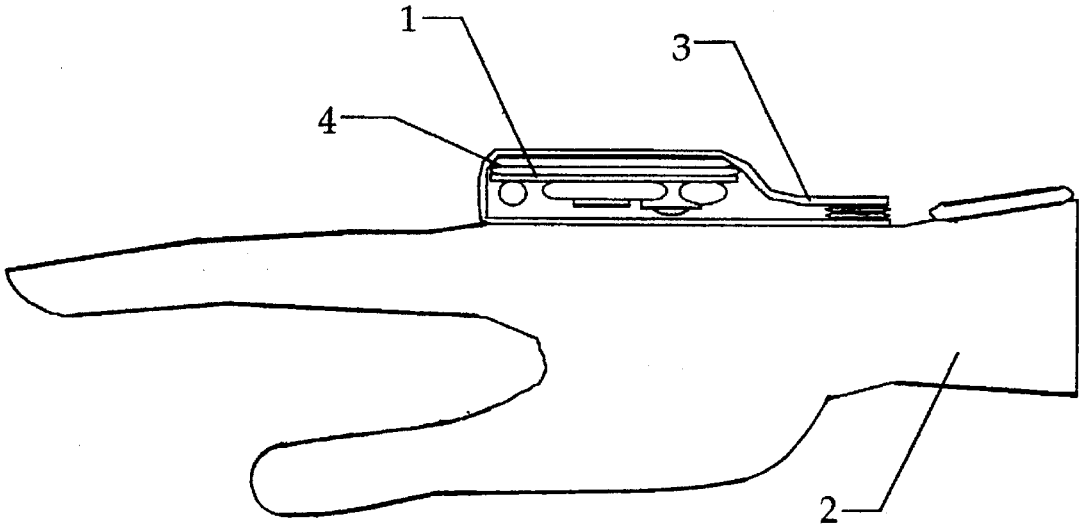
FIG. 3*b* shows a side view of the invention if a right hand glove is used.
Figure 4:
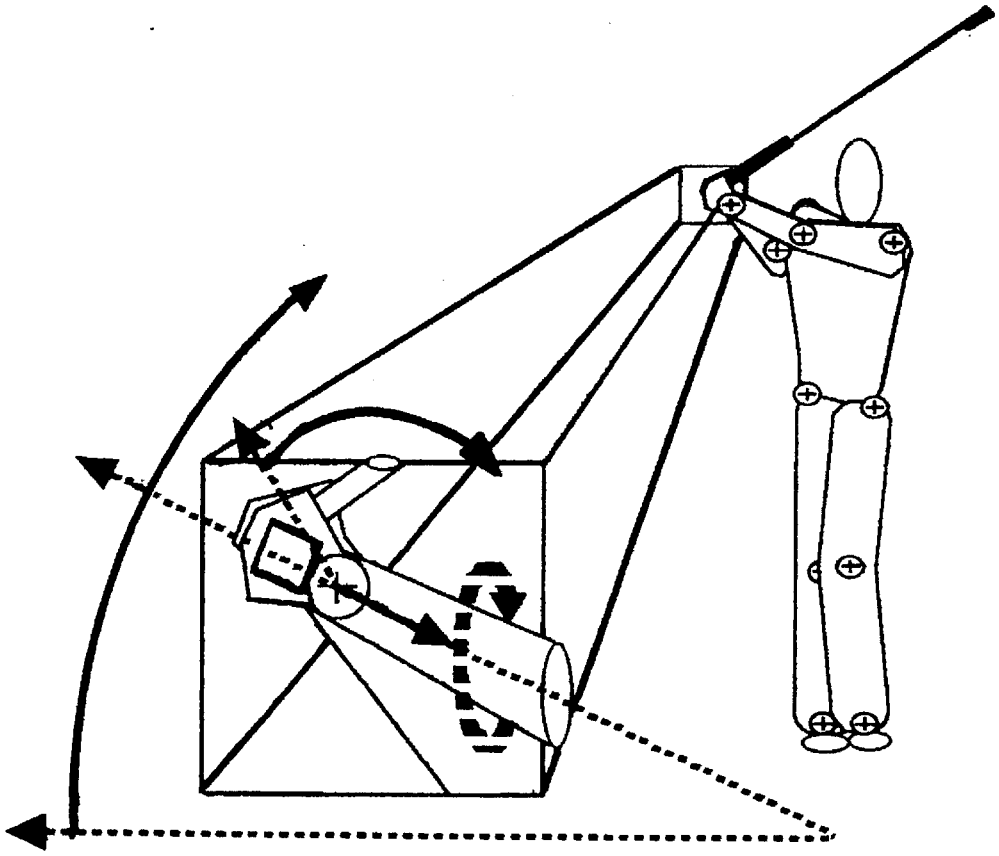
FIG. 4 shows a dynamic illustration of the invention when all predetermined angles are achieved.

FIG. 3*b* shows the same descriptions as FIGS. 2 and 3*a* except it shows the relative position of the sensing mechanism 1 for the glove 2 of the lead arm of a golfer with a left handed swing (i.e. a right hand glove). The sensing mechanism 1 is shown as attached to the inner top of the pocket by fastening material 4 such as velcro. The pocket is closed near the wrist by fastening material 3. Thus, the sensing mechanism will work in the same fashion for either left or right handed players.

I claim:

1. A sport training device attachable to the human hand and wrist comprising in combination:

a) glove means attachable to a human hand and wrist;

b) sizing means for adjusting said glove means to fit said human hand and wrist;

c) sensing means including an electronic circuit attached to said glove means for sensing angular movement between the human arm and wrist by detecting the position of the wrist in a swing plane substantially parallel to a predetermined plane, said electronic circuit including a first elevation sensitive sensor and a second elevation sensitive sensor, said second elevation sensitive sensor being positioned relative to said first elevation sensitive sensor such that when said first elevation sensitive sensor and said second elevation sensitive sensor are both positioned in a reference plane, the wrist is positioned in said swing plane and said first elevation sensitive sensor and said second elevation sensitive sensor complete said electronic circuit;

d) signaling means for providing a signal when said first elevation sensitive sensor and said second elevation sensitive sensor are both substantially positioned in said reference plane to signal the positioning of the wrist in said swing plane; and e) a power source for energizing said sensing means and signal means.

2. A sport training device as recited in claim 1 wherein said attachment means is a modified glove attachable to the human hand and wrist.

3. A sport training device as recited in claim 1 wherein said glove means is not gender specific and is adjustable for all sizes.

4. A device of claim 1 wherein the angular movements capable of being sensed by the sensing means are those created between the wrist, rotation of the forearm and elevation of the arm relative to the shoulder joint.

5. The sport training device as recited in claim 1 in which said first elevation sensitive sensor and said second elevation sensitive sensor are elevation sensitive switches.

6. A sport training device mountable to a glove for training an athlete to use the proper swing, said training device comprising:

a) a pair of sensors configured for sensing the positioning of the arm of said athlete in a swing plane defined by said proper swing, said sensors being positioned and oriented relative to one another such that when both of said sensors are positioned in a first plane, the wrist wearing said glove is positioned in a second plane substantially parallel to said swing plane;

b) a signal device coupled to said sensors, said signal device providing a signal when both of said sensors are substantially positioned in said first plane; and c) a power source for energizing said sensors and said signal device.

7. The sport training device as recited in claim 6 in which said sensors are elevation sensitive switches.

8. The sport training device as recited in claim 6, and further comprising a glove coupled to said training device.

9. A method of training a golfer to use the proper golf swing comprising the steps of:

positioning an attachment body on the lead arm of said golfer, mounting a sensor assembly to said attachment body, said sensor assembly having a pair of elevation sensitive sensors and a signal device coupled to said sensors to provide a signal when both of said sensors are substantially positioned in a reference plane, said sensor assembly being oriented relative to said attachment body such that when the wrist of said lead arm is located in a selected plane during the golf swing, said elevation sensitive sensors are positioned in said reference plane and said signal device provides a signal for said golfer; and activating a power source to supply power to said sensor assembly.

10. The method as recited in claim 9 in which said attachment body is a glove and in which said positioning step comprises positioning said glove on the hand of said lead arm and said mounting step comprises mounting said sensor assembly to said glove.

11. The sport training device as recited in claim 6 in which said sensors are positioned such that when both of said sensors are substantially positioned in said first plane, the wrist of said athlete is held at a first angle relative to the arm of said athlete, the arm is pivoted to a second angle about the longitudinal axis of the arm, and the arm is oriented at a third angle relative to the shoulders of said athlete.

* * * * *